United States Patent [19]

Snyder

[11] Patent Number: 4,697,731

[45] Date of Patent: Oct. 6, 1987

[54] COLLAPSIBLE BULK SHIPPING CONTAINER WITH TAKE-OUT FRONT PANEL

[75] Inventor: Teddy R. Snyder, Maumee, Ohio

[73] Assignee: OI Forest Products STS Inc., Toledo, Ohio

[21] Appl. No.: 922,213

[22] Filed: Oct. 23, 1986

Related U.S. Application Data

[63] Continuation-in-part of Ser. No. 859,957, May 5, 1986.

[51] Int. Cl.[4] ..... B65D 5/35

[52] U.S. Cl. ..... 229/23 R; 229/41 R

[58] Field of Search ..... 229/23 R, 41 R, 41 B

[56] References Cited

U.S. PATENT DOCUMENTS

| | | | |
|---|---|---|---|
| 2,534,011 | 12/1950 | Frye | 229/23 R |
| 3,214,076 | 10/1965 | Gagnon | 229/23 R |
| 3,650,459 | 3/1972 | Tucker | 229/23 R |
| 3,696,988 | 10/1972 | Nederveld | 229/23 R |
| 4,101,052 | 7/1978 | Dove | 229/23 R |

FOREIGN PATENT DOCUMENTS 25995 of 1907 United Kingdom .

*Primary Examiner*—Willis Little

*Attorney, Agent, or Firm*—Howard G. Bruss

[57] ABSTRACT

A collapsible, bulk shipping container with a take-out front panel that is made up of an inverted tray-type rectangular bottom, a collapsible three-sided body, one end of which is telescopically received in the tray-type bottom, and a removable take-out front panel that forms a tubular body with the three-sided body. The collapsible three-sided body is collapsible from a fully open position, in which it is U-shaped in configuration and in which it and the removable take-out panel form a tubular body which fills the tray-type bottom, into a collapsed condition in which it lies against one side of the tray-type bottom, one side of the collapsible three-sided body, the middle side, being secured to one side of the tray-type bottom. When the collapsible three-sided body has been collapsed, it can be folded over to lie against the tray-type bottom in a compact configuration for ease of the shipment or storage of at least these components of the bulk shipping container. The tray-type bottom and the collapsible three-sided bottom are preferably formed from unitary blanks of corrugated fiberboard, and the removable take-out panel is preferably formed from a blank of corrugated fiberboard with opposed minor panels foldably attached to the edges thereof to facilitate the retention of the removable take-out panel in the assembled bulk shipping container.

15 Claims, 8 Drawing Figures

COLLAPSIBLE BULK SHIPPING CONTAINER WITH TAKE-OUT FRONT PANEL

CROSS-REFERENCE TO RELATED APPLICATION

This application is a continuation-in-part of my copending application Ser. No. 859,957, filed on May 5, 1986, the disclosure of which is hereby incorporated herein by reference.

BACKGROUND OF THE INVENTION

1. Field Of The Invention

This invention relates to a collapsible corrugated fiberboard shipping container for shipping relatively large volumes and weights of materials in bulk. The container has a front panel that can be removed from the other elements of the container to facilitate the loading and the unloading of the container. A container according to the present invention can be permanently attached to or placed on a conventional wood or plastic pallet or a slip sheet for use and reuse with such pallet or slip sheet, or it can be used and reused without an associated pallet or slip sheet.

2. Description Of The Prior Art

Collapsible corrugated fiberboard containers have been proposed for use in the shipment of bulk materials, the collapsibility of such containers permitting the convenient return of such containers to the shipping point, after the emptying of the containers, to permit the reuse of such containers. The volume of such containers is frequently very large, which permits the packaging of large weights of bulk materials therein. Because the weight of the filled container can often be beyond the handling capabilities of the personnel who are engaged in the shipping or other handling of the filled container, it is usually necessary to design the container to be handled by means of a forklift truck. Thus, certain of such collapsible fiberboard containers are designed to be attached to a conventional wood or plastic pallet and to be shipped with the associated pallet in filled condition throughout the movement of the filled container, and to be shipped in collapsed condition with the associated pallet back to the shipping point to permit the reuse of the container. U.S. Pat. No. 4,373,637 (Shippell) and 3,291,364 (Fischer) describe collapsible, pallet mounted, corrugated fiberboard shipping containers of the aforesaid type.

Frequently, however, it is desired to provide a collapsible corrugated fiberboard bulk shipping container which can be used independently of a plastic or wood pallet, to avoid the need for accommodating the weight and volume of the pallet in the return of the collapsed container for refilling and reuse. It is possible to mechanically handle a heavy, filled bulk container without having a pallet thereunder, by placing the container on a thin sheet of paper or other sheetlike material, known as a slip sheet, which readily permits a forklike truck tool to engage a free end of the slip sheet to permit the mechanical handling of the filled container. The use of such a slip sheet is described in U.S. Pat. No. 4,153,161 (Taylor, et al.). Collapsible, corrugated fiberboard bulk shipping containers which are designed to be used without associated pallets are shown, for example, in U.S. Pat. No. 4,405,077 (Kupersmit) and 4,252,266 (Kupersmit).

SUMMARY OF THE INVENTION

According to the present invention there is provided a collapsible reusable bulk shipping container which can be readily fabricated from singlewall, doublewall or triplewall corrugated fiberboard or from any other suitable foldable, sheetlike material, and which can be used in a form in which it is secured to a wood or plastic pallet, or to a slip sheet, or which can be used independently of such a pallet or such a slip sheet according to the wishes of the user. The bulk container according to the present invention, when erected, has the configuration of a parallelepiped, one surface, the top surface in the normal orientation of the container, being open to permit the filling and emptying of the container. This open top of the container can, of course, if desired, be closed by a separate inverted, tray-type closure which telescopes over the upper portion of the container, but the design of such a closure can be conventional, and will not be further described herein.

In any case, the open top, parallelepiped container of the present invention is formed in three separate elements which are then joined together into the assembled collapsible container. The first of the elements is a special, shallow tray-type element which serves as the bottom of the container and which has a rectangular opening that faces upwardly when the container is in its normal orientation. The second of the elements is a collapsible, three-sided structure, the bottom portion of which is telescoped into the tray-type element. The three-sided structure, when it is fully opened, has a pair of opposed sides, each of which is adapted to lie adjacent to and substantially coextensive with the inside of one of the four sides of the shallow, tray-type element and a third side which is foldably attached to and extends between the ends of the pair of opposed sides. The third side is positioned to lie adjacent to the inside of one of the sides of the tray-type element, and it is adhesively or otherwise secured to the inside of such side. The other two sides of the three-sided structure float with respect to, or are unsecured to, the two sides of the tray-type element to which they are adjacent in the erected container, and when the container is erected, the configuration of the three-sided structure is generally U-shaped. Each of the pair of opposed sides of the three-sided structure is foldable with respect to the third side along a vertical score line, to permit the collapsing of such sides by the inward folding thereof. The container is completed by a third member that is not securely attached to either the tray-type element or the three-sided structure. The third member forms the fourth side of a four-sided tubular structure, the other three sides of which are formed by the three-sided structure when it is in its fully opened position. The third member is held by friction in the erected container, and may be disassociated from and later reassociated with the other two elements of the container to facilitate the loading or unloading of the container.

Once collapsed, the three-sided structure of the container of the present invention can be folded over from a vertical orientation in its erected condition to a horizontal orientation in its collapsed condition, and the dimensions of the sides of the three-sided structure of the container may be such that the three-sided structure, when collapsed, in many cases will lie entirely within the periphery of the tray-type element in a neat, compact arrangement.

Accordingly, it is an object of the present invention to provide an improved collapsible bulk shipping container. More particularly, it is an object of the present invention to provide a collapsible, bulk shipping container which can be used with or without an associated pallet according to the wishes of the user. It is also an object of the present invention to provide a reusable, collapsible, multiple component, open-top bulk shipping container which can be fabricated from blanks of a simple configuration, each of which blanks can be formed of a suitable rigid, foldable sheetlike material. It is yet another object of the present invention to provide a bulk shipping container that incorporates a vertically extending panel portion which can be readily disassociated from, and reassociated with, the other elements of the container to facilitate the loading and unloading of the container. It is also an object of the present invention to provide a collapsible, multi-component, reusable bulk shipping container, which container can be collapsed into a compact configuration that wastes little space during the transportation of such a container in its collapsed condition.

For a further understanding of the present invention and the objects thereof, attention is directed to the drawings and the following brief description thereof, to the detailed description of the preferred embodiment and to the appended claims.

DETAILED DESCRIPTION OF THE PREFERRED EMBODIMENT

Figure 1:
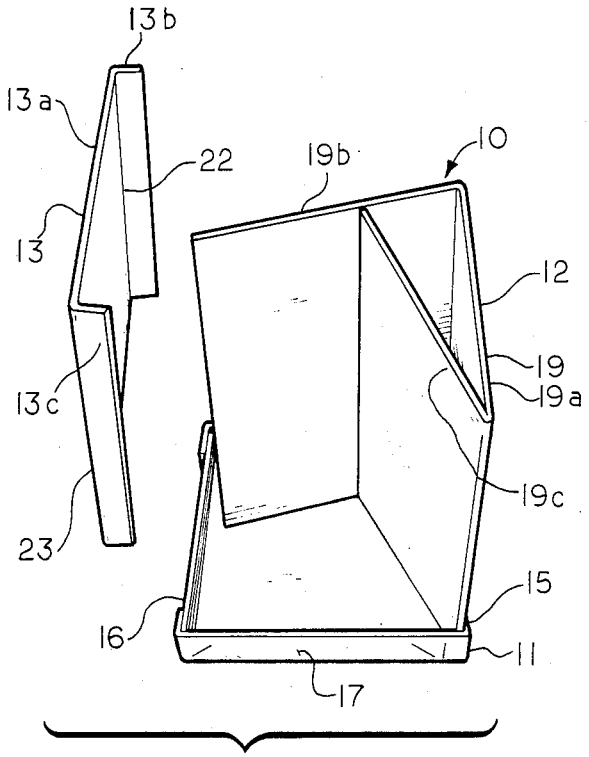
FIG. 1 is a perspective view of a preferred embodiment of a collapsible shipping container according to the present invention in a partially erected state.
Figure 2:
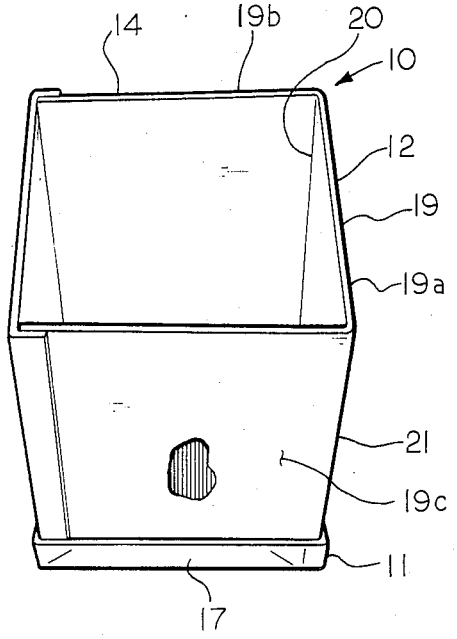
FIG. 2 is a view of the shipping container of FIG. 1 in its fully erected state.
Figure 3:
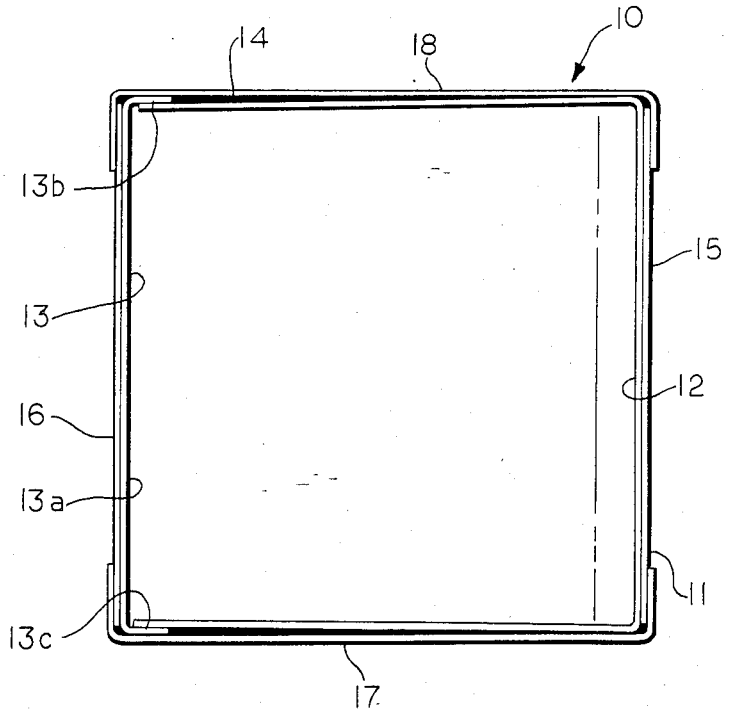
FIG. 3 is a plan view, at an enlarged scale, of the shipping container of the present invention as depicted in FIG. 2.

As is shown in FIGS. 1 through 3, a container according to the preferred embodiment of the present invention, identified generally by reference numeral 10, includes a bottom 11 in the form of a tray, a three-sided, U-shaped body 12, the bottom portion of which is telescoped into the bottom 11, and a take-out panel element 13 which is also telescoped, but removably, into the bottom 11 and which forms a tubular body 14 with the three-sided body 12. The bottom 11 of the container 10 is generally quadrilateral in configuration, preferably generally rectangular, and has a first pair of opposed sides 15 and 16 and a second pair of opposed sides 17 and 18, each of the second pair of sides 17 and 18 extending between the opposed ends of the first pair of sides 15 and 16. The first pair of opposed sides 15 and 16 is shown as being approximately equal in length to the second pair of opposed sides 17 and 18, but may also be either greater in length or lesser in length, as desired.

The three-sided body 12, in the illustrated embodiment, is formed from a foldable sheetlike piece 19, such as a sheet of corrugated fiberboard. The sheetlike piece 19 is scored or otherwise deformed along a pair of spaced apart vertical lines 20 and 21 to permit it to be folded into a U-shaped configuration, as is shown in FIG. 2, with an intermediate side **19*a* and a pair of free end sides 19*b* and 19*c* which are foldably attached to the intermediate side 19*a* at the vertical lines 20 and 21, respectively. When the three-sided body 12 is fully erected, the intermediate side 19*a* of the sheetlike piece 19 will be disposed next to, and will be substantially coextensive with, the side 15 of the first pair of sides of the bottom 11; the free end side 19*b* of the sheetlike piece 19 will be disposed next to, and will be substantially coextensive with, the side 18 of the second pair of sides of the bottom 11; and the free end side 19*c* of the sheetlike piece 19 will be disposed next to, and will be substantially coextensive with, the side 17 of the second pair of sides of the bottom 11. In the illustrated embodiment, the only dimensional requirement of the container 10, as heretofore described, is that the intermediate side 19*a* can not be shorter than the free end sides 19*b* and 19*c* to permit the three-sided body 12 to be collapsed. Of course, if the free end sides 19*b* and 19*c* were each provided with one or more additional fold lines parallel to and spaced from fold lines 20 and 21, respectively to permit the folding of the free end sides 19*b* and 19*c* into two or more layers, then the intermediate side 19*a* could be shorter than the free end sides 19*b* and 19*c***.

The three-sided body 12 and the bottom 11 of the container 10 are permanently secured to one another along one of the sides of the bottom 11, shown as the side 15 of the first pair of sides, by staples, not shown, or by the application of an adhesive, not shown, to the outside of the portion of the intermediate side **19*a* of the sheetlike piece 19 which is overlapped by the side 15 of the bottom 11 and/or by the application of an adhesive to the inside of the side 15 of the bottom 11, or in any other conventional manner. The other sides of the three-sided body 12, namely the free end sides 19*b* and 19*c*, are unsecured to, and are free to move or float with respect to, the sides of the bottom 11 that they are disposed next to, namely the sides 18 and 17** respectively.

The take-out panel element 13, preferably, is made up of a major central panel **13*a* and a pair of short free end panels 13*b* and 13*c* which are foldably joined to the opposed edges of the central panel 13*a* at scored or otherwise deformed vertical fold lines 22 and 23, respectively. When telescopically inserted into the bottom 11, the major panel 13*a* of the take-out panel element will be disposed next to, and will be substantially coextensive with the side 16 of the first pair of sides of the bottom 11, the free end panel 13*b* will lie between the free end side 19*b* of the sheetlike piece 19 and the side 18 of the second pair of sides of the bottom 11, and the free end panel 13*c* of the take-out panel element 13 will lie between the free end 19*c* of the sheetlike piece 19 and the side 17 of the second pair of sides of the bottom 11. In this manner, the take-out panel element 13 can be removed from the container 10 to facilitate the loading or unloading of the container, and it can be reinserted into the filled container whereupon it will be frictionally retained in the position in the container 10 that is shown in FIG. 2, especially if the container 10 is filled, until it is desired to remove the take-out panel element at the time of the unloading of the container 10. Of course, the free ends panels 13***b* and 13*c* of the take-out panel element 13 could be positioned interiorly of the free end sides 19*b* and 19*c*, respectively, of the sheet-like piece 19 if interference between the contents of the container 10 and the edges of the free end panels 13*b* and 13*c* would not be a problem. Further, if the thickness of the take-out panel element 13 and the sheetlike piece 19 were each substantial, for example, if each were formed from triple-wall corrugated fiberboard, the free end panels 13*b* and 13*c* of the take-out panel element 13 could be aligned, respectively a with the free end sides 19*b* and 19*c* of the sheetlike piece 19.

FIG. 1 illustrates the container 10 in which the three-sided body 12 is in a partially collapsed state, a state which also corresponds to a partially open state.

Figure 4:
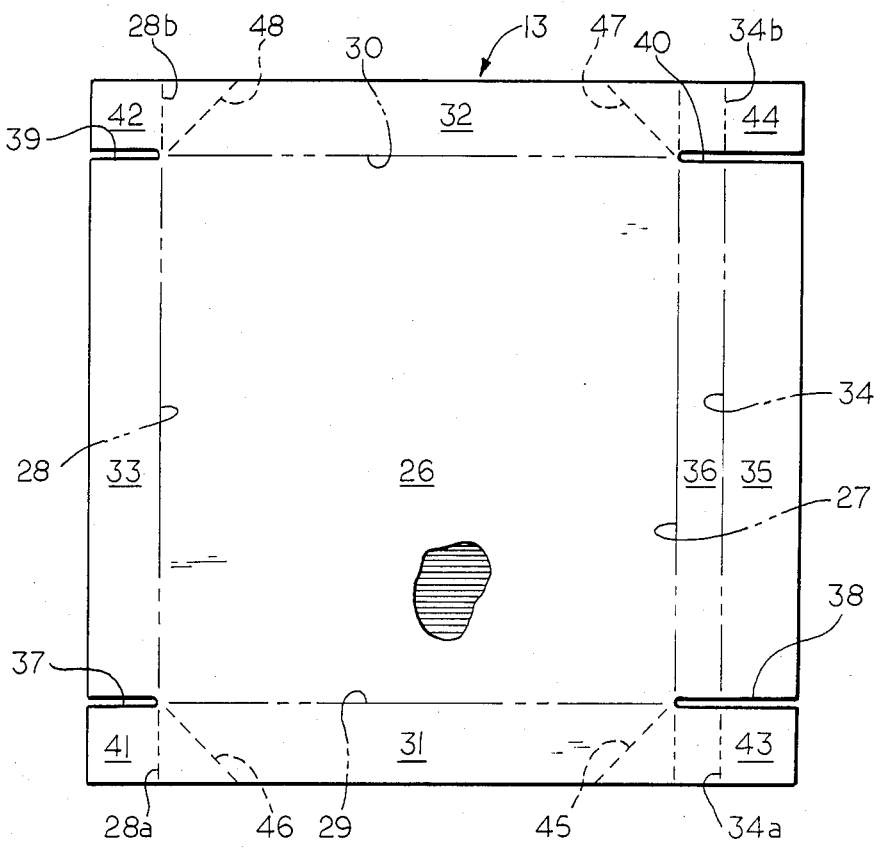
FIG. 4 is a plan view of the top of a blank for use in forming one of the elements of the shipping container depicted in FIGS. 1 through 3.

FIG. 4 illustrates a special blank B from which the bottom 11 of the container 10 is formed. The blank B has a rectangular panel 26 which forms a horizontally disposed lowermost portion of the bottom 11 of the container 10. The rectangular panel 26 is disposed generally centrally within the outline of the blank B, which also is generally of rectangular configuration, and the rectangular panel 26 is separated from the remaining portions of the blank B by fold lines 27 and 28 along a first opposed pair of sides of the rectangular panel 26 and by fold lines 29 and 30 along a second opposed pair of sides of the rectangular panel, the fold lines 27, 28, 29 and 30 being formed by deforming the blank B by scoring, slit scoring or otherwise, as is known in the art. By scoring or otherwise deforming the blank B along the fold lines 29 and 30 there is formed therein a first and second spaced apart, opposed side panels 31 and 32, respectively, and by scoring or otherwise deforming the blank B along the fold line 28 there is formed a first end panel 33 in the blank B that extends between the fold lines 29 and 30. The blank B is also scored or otherwise deformed along a fold line 34 which is spaced from and extends parallel to the fold line 27, the fold line 34 forming a second end panel 35 and an intermediate panel 36 between the fold line 27 and the fold line 34. The blank B is also cut along the extensions beyond fold lines 29 and 30 that lie beyond the ends of the rectangular panel 26 to form slots 37 and 38 at the ends of the fold line 29 and slots 39 and 40 at the ends of the fold line 30. While the slots 38 and 40 are shown as extending from the free edge of the blank B to the fold line 27, it is sufficient in certain embodiments of the invention for them to extend only to the fold line 34. In any case, the blank B is along scored or otherwise deformed also the extensions of the fold line 28 beyond the fold lines 29 and 30, as shown at 28*a* and 28*b*, respectively, and corner locking flaps 41 and 42 are formed in corners of the blank B by the slot 37 and the fold line extension 28*a*, and by the slot 39 and the fold line extension 28*b*. Thus, the side 16 of the first pair of sides and the sides 17 and 18 of the second pair of sides of the bottom 11 of the container 10 are formed by folding the first side panel 31 and the second side panel 32 to extend normally with respect to the rectangular panel 26, by folding the first end panel 33 to extend normally with respect to the rectangular panel 26, by inwardly folding the corner locking flaps 41 and 42 to overlie the end portions of the first end panel 33 and by securing the corner locking flaps 41 and 42 to the portions of the first end panel 33 by an adhesive or by staples, not shown.

The fold line 34 is also scored or otherwise deformed along the extension 34*a* and 34*b* which lie beyond the fold lines 29 and 30, thereby forming corner locking flaps 43 and 44 in the other corner of the blank B by the fold line extension 34*a* and the slot 38, and by the fold line extension 34*b* and the slot 40, respectively. Thus, the side 15 of the first pair of sides of the bottom 11 of the container 10 is formed by folding the second end panel 35 along the fold line 34 to extend normally with respect to the intermediate panel 36, by inwardly folding the corner locking flaps 43 and 44 to overlie the end portions of the second end panel 35 and by securing the corner locking flaps 43 and 44 to the portions of the second end panel 35 by an adhesive or by staples, not shown.

Figure 5:
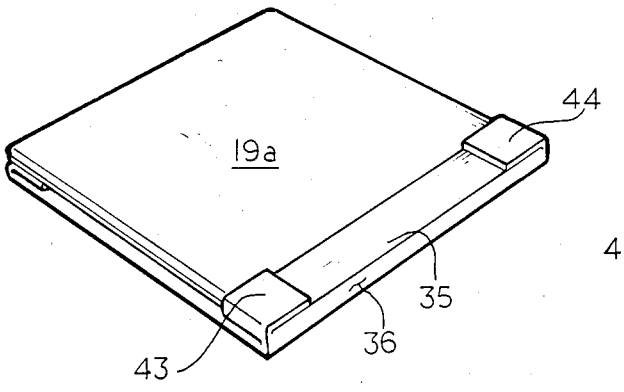
FIG. 5 is a perspective view of a portion of the shipping container of FIGS. 1 through 3 in its fully collapsed state.
Figure 6:
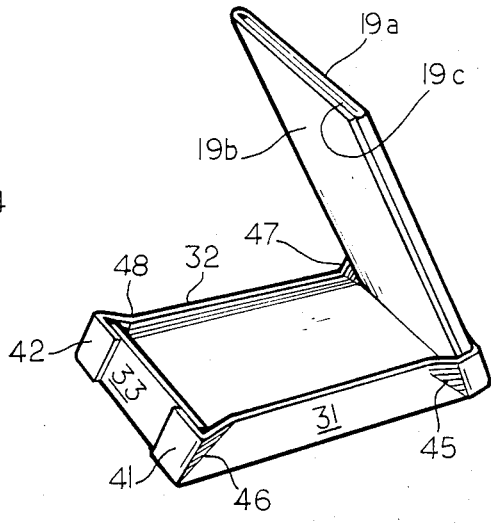
FIG. 6 is a perspective view of the portion of the shipping container in FIG. 5 showing a stage in the erection of such portion from the fully collapsed state depicted in FIG. 5.

The space between the fold line 27 and the fold line 34 is, preferably, slightly greater that the collapsed thickness of the three-sided body 12 of the container so that the end area of the collapsed three-sided body 12 can be contained entirely within the outline of the intermediate panel 36. This will permit the collapsed three-sided body and the intermediate panel 36 to be folded along the fold line 27 to lie along the rectangular panel 26 of the bottom 11 of the container 10 to permit the container 10, after the removal of the take-out panel element 13, to be collapsed in a neat, compact configuration, as is shown in FIG. 5, for ease of storage and shipment to the packing plant for the first use thereof or, in the case of a reusable container 10, for the return shipment for reuse thereof. For optimum collapsibility the first side panel 31 is provided with first and second diagonal fold lines 45 and 46 extending, respectively, from the fold lines 27 and 28 in a converging manner at a 45° angle to the fold line 29 to the nearby free edge of the blank B, the diagonal fold lines 45 and 46 preferably being formed in the underside of the blank B, and, similarly, the second side panel 32 is provided with first and second diagonal fold lines 47 and 48 extending, respectively, from the fold lines 27 and 28 in a converging manner at a 45° angle to the fold line 30 to the other edge of the blank B, the diagonal fold lines 47 and 48 also, preferably, being formed in the underside of the blank B. The diagonal fold lines 45 and 46 permit the portion of the first side panel 31 between such diagonal fold lines to be folded inwardly to overlie the rectangular panel 26 when the container 10 is collapsed, and, similarly, the diagonal fold lines 47 and 48 permit the portion of the second side panel 32 therebetween to be folded inwardly to overlie the rectangular panel 26 when the container 10 is collapsed, as is clear from FIG. 6.

The container 10 can be used with a standard wood or plastic pallet, not shown, for example, by stapling the rectangular panel 26 of the bottom 11 of the container 10 to such pallet or simply by placing or strapping the container on such pallet. However, the container 10 is not restricted to use with a pallet even in the case of a large container that is adapted to contain heavy loads, for example, a container whose first pair of sides 15 and 16 are each 48" and whose second pair of sides 17 and 18 are each 40", a container size which would be well-suited for use with a standard 40"×48" pallet, because such a container could be handled by standard forklift handling equipment, without being attached to a pallet, for example, by inserting a slip sheet (not shown) thereunder, as is shown in the art. While the container 10 as heretofore described has an open top, such open top can, of course, be closed by a separate inverted, telescoping tray-type cover or other cover, not shown, as is known in the art. The blank B, the three-sided body 12 and the take-out panel element 13 are each preferably formed from a heavy load bearing grade of corrugated fiberboard, for example, from heavy singlewall corrugated fiberboard or, preferably, for large containers, such as pallet size 40"×48" containers, from doublewall corrugated fiberboard or even, in certain cases, from triplewall corrugated fiberboard, especially if such large containers are designed to be reusable. Of course, the bottom 11 of the container 10 and the three-sided body 12 and the take-out panel element 13 thereof experience different loads in service. Hence, the grade of corrugated fiberboard that is used in the blank B is not necessarily the same as the grade that is used in the three-sided body 12 or the take-out panel element 13.

Figure 7:
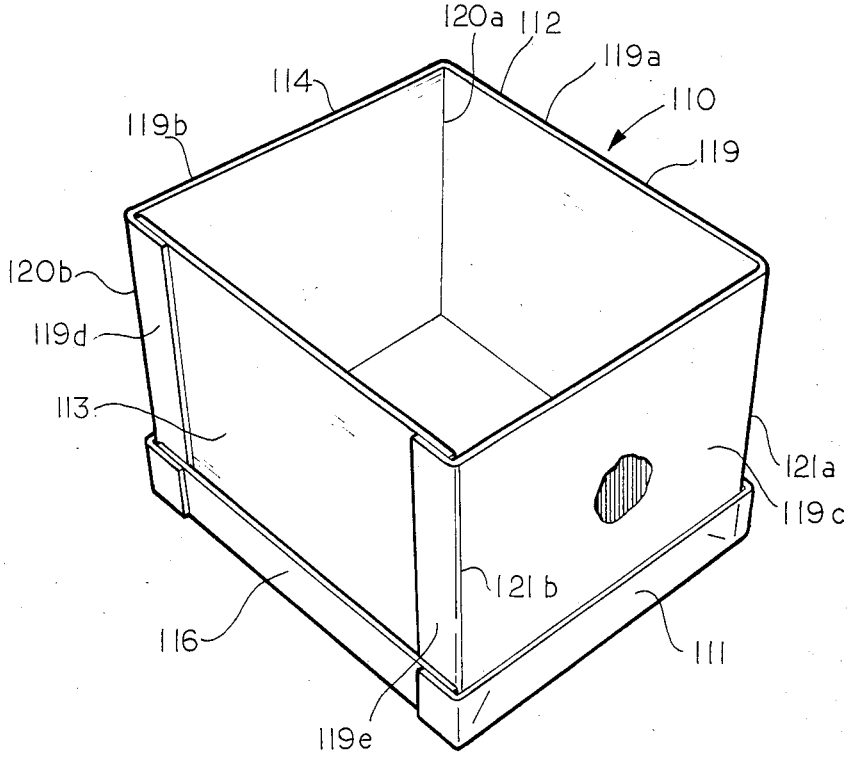
FIG. 7 is a perspective view of an alternative embodiment of a collapsible bulk shipping container according to the present invention in a fully erected state.

FIG. 7 illustrates an alternative embodiment of a container according to the present invention, which is identified generally by reference numeral 110 in the drawing. The container 110 includes a bottom 111, which may be the same as the bottom 11 of the container 10 of the embodiment of FIGS. 1 through 6, a generally U-shaped body 112, the bottom portion of which is telescoped into the bottom 111, and a take-out panel element 113 which is also telescoped but removably, into the the bottom 111 along a side 116 of the bottom 111, and which forms a tubular body 114 with the generally U-shaped body 112.

The generally U-shaped body 112 is formed from a foldable sheetlike piece 119 which is scored or otherwise deformed along four spaced-apart vertical line 120*a*, 120*b*, 121*a*, and 122*b* to be folded into the configuration shown in FIG. 7, with an intermediate side 119*a*, a pair of sides 119*b* and 119*c* which are foldably attached to the intermediate side 119*a* at the fold lines 120*a* and 121*a*, respectively, and a pair of inturned flanges 119*d* and 119*e* which are foldably attached to the sides 119*b* and 119*c*, respectively, at fold lines 120*b* and 121*b*. By the use of the inturned flanges 119*d* and 119*e*, it is possible to use a flat sheet of corrugated fiberboard or the like as the take-out panel element 113, without the need for foldable free end panels such as the free end panels 13*c* and 13*d* of the embodiment of FIGS. 1 through 6, since the inturned flanges 119*d* and 119*e* help to prevent the take-out panel element 113 from tipping with respect to the bottom 111 of the container 110 which was the function of the free end panels 13*c* and 13*d* of the take-out panel element 13 with respect to the bottom 11 of the container 10 of the embodiment of FIGS. 1 through 6. The embodiment of FIG. 7 is disadvantageous, with respect to the embodiment of FIGS. 1 through 6 in that, upon the removal of the take-out panel element 113, it presents a narrower portion of the side 116 of the bottom of 111 of the container 110 for loading and unloading, due to the presence of the inturned flanges 119*d* and 119*e*, and it requires a wider foldable sheetlike piece 119 to fabricate the generally U-shaped body 112 which, in the case of the large, bulk containers, may serve as a size limiting factor that is determined by the width of the corrugating or other machine on which the foldable sheetlike piece 119 is produced. Conversely, however, the embodiment of FIG. 7 reduces the required width of the take-out panel element 113 and the need to process such take-out panel element 113 to provide score lines therein. This makes it economically more possible to reuse the subassembly that includes the generally U-shaped member 112 and the bottom 111 with a new take-out panel element 113 upon each such reuse, since the take-out panel element 113, like the take-out panel element of 13 of the embodiment of FIGS. 1 through 6, is not permanently secured to any of the other elements of the container in which it is used.

Figure 8:
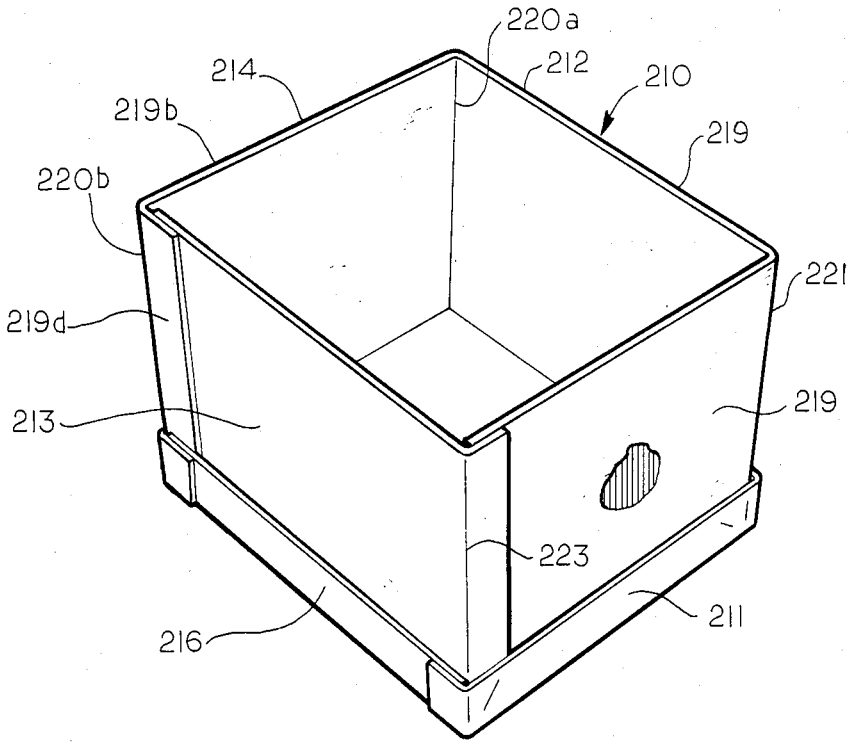
FIG. 8 is a view similar to FIG. 7 of yet another alternative embodiment of a bulk shipping container according to the present invention.

FIG. 8 illustrates yet another embodiment of a container according to the present invention, which is identified generally by reference numeral 210 in the drawing. The container 210, which combines certain features of the container 10 of the embodiment of FIGS. 1 through 6 and certain features of the container 110 of the embodiment of FIG. 7, includes a bottom 211 which may be the same as the bottom 11 of the container 10 and the bottom 111 of the container 110, and further includes a generally U-shaped body 212, the bottom portion of which is telescoped into the bottom 211 and a take-out panel element 213 which is removably telescoped into the bottom 211 along a side 216 of the bottom 211 and which forms a tubular body 214 with the generally U-shaped body 212.

The generally U-shaped body 212 is formed from a foldable sheet like piece 219 which is scored or otherwise deformed along three spaced apart vertical lines 220*a*, 220*b* and 221 to be folded into the configuration shown in FIG. 8, with an intermediate side 219*a*, a pair of sides 219*b* and 219*c* which are foldably attached to the intermediate side 219*a* at the fold lines 220*a* and 221, respectively, and an inturned flange 219*d* which is foldably attached to the side 219*b* at the fold line 220*b*. The take-out panel element 213 has a major central panel 213*a* and a short free end panel 213*c* which is foldably joined to an edge of the central panel 213 at a scored or otherwise deformed vertical fold line 223. When telescopically inserted into the bottom 211, the major central panel 213*a* of the take-out panel element 213 will be supported against tipping with respect to the bottom 211 of the container 210 at one of its vertical edges by its short free end panel 213*c* and at the other of its vertical edges by the inturned flange 219*d* of the foldable sheetlike piece 219.

Although the best mode contemplated by the inventor for carrying out the present invention as of the filing date hereof has been shown and described herein, it will be apparent to those skilled in the art that suitable modifications, variations, and equilvalents may be made without departing from the scope of the invention, such scope being limited solely by the terms of the following claims.

What is claimed is:

1. A collapsible bulk shipping container comprising:

a tray-type bottom, said tray-type bottom having:

a rectangular bottom panel, said rectangular bottom panel having a first pair of opposed, spaced-apart edges and a second pair of opposed, spaced-apart edges, said second pair of opposed, spaced-apart edges extending transversely between said first pair of opposed, spaced-apart edges;

a first pair of panel means, one of said first pair of panel means being foldably attached to one of said first pair of opposed, spaced-apart edges of said rectangular bottom panel, at least a portion of said one of said first pair of panel means being foldable with respect to said rectangular bottom panel from a first position in which said at least a portion of said one of said first pair of panel means extends generally parallel to said rectangular bottom panel to a second position in which said at least a portion of said one of said first pair of panel means extends generally normally from said rectangular bottom panel, at least a portion of the other of said first pair of panel means being foldably attached to the other of said first pair of opposed, spaced-apart edges of said rectangular bottom panel, said at least a portion of said other of said first pair of panel means being foldable with respect to said rectangular bottom panel from a first position in which said at least a portion of said other of said first pair of panel means extends generally parllel to said rectangular bottom panel to a second position in which said at least a portion of said other of said first pair of panel means extends generally normally from said rectangular bottom panel;

a second pair of panel means, one of said second pair of panel means being foldably attached to one of said second pair of opposed, spaced-apart edges of said rectangular bottom panel, said one of said second pair of panel means being foldable with respect to said rectangular bottom panel from a first position in which said one of said second pair of panel means extends generally parallel to said rectangular bottom panel to a second position in which said one of said second pair of panel means extends generally normally from said rectangular bottom panel, the other of said second pair of panel means being foldably attached to the other of said second pair of opposed, spaced-apart edges of said rectangular bottom panel; and an intermediate panel, said intermediate panel being directly foldably attached to said other of said second opposed, spaced-apart edges of said rectangular bottom panel, said other of said second pair of panel means being foldably attached to said other of said second pair of opposed, spaced-apart edges of said rectangular bottom panel by being foldably attached to said intermediate panel, said other of said second pair of panel means being foldably attached to said intermediate panel along a fold line which is spaced from and which extends generally parallel to said other of said second pair of opposed, spaced-apart edges of said rectangular bottom panel;

a collapsible three-sided structure which is partially telescopically disposed within said tray-type bottom and which is collapsible from a first, open configuration in which said collapsible three-sided structure has a generally U-shaped configuration to a second, collapsed configuration, said collapsible three-sided structure extending generally normally from said rectangular of said tray-type bottom when said collapsible three-sided structure is in said first, open configuration and extending generally parallel to said rectangular bottom panel of said tray-type bottom when said collapsible three-sided structure is in said second, collapsed configuration, the space between said fold line of said tray-type bottom and said other of said second pair of opposed, spaced-apart edges of said rectangular bottom panel being substantially at least as great as the thickness of said collapsible three-sided structure in its second collapsed configuration so that said collapsible three-sided structure, when in its second, collapsed configuration, will be contained within the outline of said intermediate panel, said collapsible three-sided structure further having:

a first side, said first side of said collapsible three-sided structure being disposed adjacent to, and being substantially coextensive with, said otherof said second pair of panel means of said tray-type bottom, said first side being secured to said otherof said second pair of panel means of said tray-type bottom; and a pair of opposed sides, each of said pair of opposed sides being foldably attached to said first side, one of said pair of opposed sides being disposed adjacent to one of said first pair of panel means of said tray-type bottom when said collapsible three-sided structure is in said first, open configuration, the other of said pair of opposed sides being disposed adjacent to the other of said first pair of panel means of said tray-type bottom when said collapsible three-sided structure is in said first, open configuration, said collapsible three-sided structure further having vertical fold line means therein to permit said each of said pair of opposed sides to be folded inwardly about said vertical fold line means toward the other of said pair of opposed sides upon the collapsing of said collapsible three-sided structure into said second, collapsed configuration; and panel means which are separately telescopically insertable into, and which are removable from, said tray-type bottom, said panel means defining a tubular structure when said collapsible three-sided structure is in said first, open configuration and said panel means is telescoped into said tray-type bottom.

2. A collapsible bulk shipping container according to claim 18 in which each of said second pair of panel means of said tray-type bottom comprises:

first and second spaced-apart diagonal score line means therein to permit the portion of said each of said second pair of panel means between said first and second spaced-apart diagonal fold lines to be folded inwardly into said first position in which said portion extends generally parallel to said rectangular bottom panel of said tray-type bottom when said collapsible tubular structure of said collapsible bulk shipping container, when in its second, collapsed configuration, is folded with respect to said tray-type bottom to extend generally parallel to said rectangular bottom panel of said tray-type bottom.

3. A collapsible bulk shipping container according to claim 1 in which said tray-type bottom is formed from a unitary blank of a foldable sheetlike material.

4. A collapsible bulk shipping container according to claim 3 in which said foldable sheetlike material is corrugated fiberboard.

5. A collapsible bulk shipping container according to claim 4 in which said collapsible three-sided structure is formed from a second foldable sheetlike material.

6. A collapsible bulk shipping container according to claim 5 in which said second foldable sheetlike material is corrugated fiberboard.

7. A collapsible bulk shipping container according to claim 6 in which said corrugated fiberboard is multiwall corrugated fiberboard.

8. A collapsible bulk shipping container according to claim 1 where said panel means comprises:

a major panel having an opposed pair of edges, said major panel being disposed adjacent to, and being substantially coextensive with the other of said second pair of panel means of said tray-type bottom when said panel means is telescoped into said tray-type bottom; and at least one minor panel, said at least one minor panel being foldably attached to one of said opposed pair of edges of said major panel and being disposed adjacent to one of said first pair of panel means of said tray-type bottom when said panel means is telescoped into said tray-type bottom.

9. A collapsible bulk shipping container according to claim 8 wherein said panel means further comprises:

a second minor panel, said second minor panel being foldably attached to the other of said opposed pair of edges of said major panel and being disposed adjacent to the other of said first pair of panel means of said tray-type bottom when said panel means is telescoped into said tray-type bottom.

10. A collapsible bulk shipping container according to claim 9 wherein said panel means is formed from a unitary blank of a third foldable, sheetlike material.

11. A collapsible bulk shipping container according to claim 10 wherein said third foldable, sheetlike material is corrugated fiberboard.

12. A collapsible bulk shipping container according to claim 1 in which each of said second pair of panel means of said tray-type bottom comprises:

first and second spaced-apart diagonal score line means therein to permit the portion of said each of said second pair of panel means between said first and second spaced-apart diagonal fold lines to be folded inwardly into said first position in which said portion extends generally parallel to said rectangular bottom panel of said tray-type bottom when said collapsible tubular structure of said collapsible bulk shipping container, when in its second, collapsed configuration is folded with respect to said tray-type bottom to extend generally parallel to said rectangular bottom panel of said tray-type bottom.

13. A collapsible bulk shipping container comprising:

a tray-type bottom, said tray-type bottom having:

a rectangular bottom panel, said rectangular bottom panel having a first pair of opposed, spaced-apart edges and a second pair of opposed, spaced-apart edges, said second pair of opposed, spaced-apart edges extending transversely between said first pair of opposed, spaced-apart edges;

a first pair of panel means, one of said first pair of panel means being foldably attached to one of said first pair of opposed, spaced-apart edges of said rectangular bottom panel, at least a portion of said one of said first pair of panel means being foldable with respect to said rectangular bottom panel from a first position in which said at least a portion of said one of said first pair of panel means extends generally parallel to said rectangular bottom panel to a second position in which said at least a portion of said one of said first pair of panel means extends generally normally from said rectangular bottom panel, at least a portion of the other of said first pair of panel means being foldably attached to the other of said first pair of opposed, spaced-apart edges of said rectangular bottom panel, said at least a portion of said other of said first pair of panel means being foldable with respect to said rectangular bottom panel from a first position in which said at least a portion of said other of said first pair of panel means extends generally parallel to said rectangular bottom panel to a second position in which said at least a portion of said other of said first pair of panel means extends generally normally from said rectangular bottom panel; and a second pair of panel means, one of said second pair of panel means being foldably attached to one of said second pair of opposed, spaced-apart edges of said rectangular bottom panel, said one of said second pair of panel means being foldable, with respect to said rectangular bottom panel, from a first position in which said one of said second pair of panel means extends generally parallel to said rectangular bottom panel to a second position in which said one of said second pair of panel means extends generally normally from said rectangular bottom panel, the other of said second pair of panel means being foldably attached to the other of said second pair of opposed, spaced-apart edges of said rectangular bottom panel;

a collapsible three-sided structure which is partially telescopically disposed within said tray-type bottom and which is collapsible from a first, open configuration in which said collapsible three-sided structure has a generally U-shaped configuration to a second, collapsed configuration, said collapsible three-sided structure having:

a first side, said first side of said collapsible three-sided structure being disposed adjacent to, and being substantially coextensive with, one of said second pair of panel means of said tray-type bottom, said first side being secured to said one of said second pair of panel means of said tray-type bottom; and a pair of opposed sides, each of said pair of opposed sides being foldably attached to said first side, one of said pair of opposed sides being disposed adjacent to one of said first pair of panel means of said tray-type bottom when said collapsible three-sided structure is in said first, open configuration, the other of said pair of opposed sides being disposed adjacent to the other of said first pair of panel means of said tray-type bottom when said collapsible three-sided structure is in said first, open configuraton, said collapsible three-sided structure further having vertical fold line means therein to permit said each of said pair of opposed sides to be folded inwardly about said vertical fold line means toward the other of said pair of opposed sides upon the collapsing of said collapsible three-sided structure into said second, collapsed configuration, each of said pair of opposed sides of said collapsible three-sided having an inturned flange which is foldably attached to said each of said pair of opposed sides of said collapsible three-sided structure, the inturned flange of each of said pair of opposed sides of said collapsible three-sided structure being disposed adjacent to the other of said second pair of panel means of said tray-type bottom when said collapsible three-sided structure is in said first open configuration; and panel means which are separately telescopically insertable into, and which are removable from, said tray-type bottom, said panel means defining a tubular structure with said collapsible three-sided structure is in said first, open configuration and said panel means is telescoped into said tray-type bottom.

14. A collapsible bulk shipping container according to claim 13 wherein the inturned flange of said each of said pair of opposed sides of said collapsible three-sided structure has a free edge, and wherein the free edge of one of said pair of opposed sides of said collapsible three-sided structure is spaced apart from the free edge of the other of said pair of opposed sides of said collapsible three-sided structure when said collapsible three-sided structure is in said first, open configuration.

15. A collapsible bulk shipping container comprising:

a tray-type bottom, said tray-type bottom having:

a rectangular bottom panel, said rectangular bottom panel having a first pair of opposed, spaced-apart edges and a second pair of opposed, spaced-apart edges, said second pair of opposed, spaced-apart edges extending transversely between said first pair of opposed, spaced-apart edges;

a first pair of panel means, one of said first pair of panel means being foldably attached to one of said first pair of opposed, spaced-apart edges of said rectangular bottom panel, at least a portion of said one of said first pair of panel means being foldable with respect to said rectangular bottom from a first position in which said at least a portion of said one of said first pair of panel means extends generally parallel to said rectangular bottom panel to a second position in which said at least a portion of said one of said first pair of panel means extends generally normally from said rectangular bottom panel, at least a portion of the other of said first pair of panel means being foldably attached to the other of said first pair of opposed, spaced-apart edges of said rectangular bottom panel, said at least a portion of said other of said first pair of panel means being foldable with respect to said rectangular bottom panel from a first position in which said at least a portion of said other of said first pair of panel menas extends generally parallel to said rectangular bottom panel to a second position in which said at least a portion of said other of said first pair of panel means extends generally normally from said rectangular bottom panel; and a second pair of panel means, one of said second pair of panel means being foldably attached to one of said second pair of opposed, spaced-apart edges of said rectangular bottom panel, said one of said second pair of panel means being foldable, with respect to said rectangular bottom panel, from a from a first position in which said one of said second pair of panel means extends generally parallel to said rectangular bottom panel to a second position in which said one of said second pair of panel means extends generally normally from said rectangular bottom panel, the other of said second pair of panel means being foldably attached to the other of said second pair of opposed, spaced-apart edges of said rectangular bottom panel;

a collapsible three-sided structure which is partially telescopically disposed within said tray-type bottom and which is collapsible from a first, open configuration in which said collapsible three-sided structure has a generally U-shaped configuration to a second, collapsed configuration, said collapsible three-sided structure having:

a first side, said first side of said collapsible three-sided structure being disposed adjacent to, and being substantially coextensive with, one of said second pair of panel means of said tray-type bottom, said first side being secured to said one of said second pair of panel means of said tray-type bottom; and a pair of opposed sides, each of said pair of opposed sides being foldably attached to said first side, one of said pair of opposed sides being disposed adjacent to one of said first pair of panel means of said tray-type bottom when said collapsible three-sided structure is in said first, open configuration, the other of said pair of opposed sides being disposed adjacent to the other of said first pair of panel means of said tray-type bottom when said collapsible three-sided structure is in said first, open configuration, said collapsible three-sided structure further having vertical fold line means therein to permit said each of said pair of opposed sides to be folded inwardly about said vertical fold line means toward the other of said pair of opposed sides upon the collapsing of said collapsible three-sided structure into said second, collapsed configuration; and panel means which are separately telescopically insertable into, and which are removable from, said tray-type bottom, said panel means defining a tubular structure with said collapsible three-sided structure is in said first, open configuration and said panel means is telescoped into said tray-type bottom, said panel means comprising a central panel and a free end panel that is foldably attached to an end of said central panel along a vertically extending fold line, and wherein one of said pair of said opposed sides of said collapsible three-sided structure has an inturned flange which is foldably attached to one of said pair of opposed sides of said collapsible three-sided structure, said intruned flange being disposed adjacent to the other of said second pair of panel means of said tray-type bottom and adjacent to a second edge of said central panel said second edge of said central panel being spaced from and extending generally parallel to said edge of said central panel.

* * * * *

UNITED STATES PATENT AND TRADEMARK OFFICE

CERTIFICATE OF CORRECTION

PATENT NO. : 4,697,731

DATED : October 6, 1987

INVENTOR(S) : Teddy R. Snyder

It is certified that error appears in the above-identified patent and that said Letters Patent are hereby corrected as shown below:

Column 5, Line 16, change "a" to a comma (,).

Claim 1, Column 9, Line 14, change "parllel" to -- parallel --.

Claim 1, Column 10, Line 9, change "otherof" to -- other of --.

Claim 1, Column 10, Line 12, change "otherof" to -- other of --.

Claim 2, Column 10, Line 41, change "18" to -- 1 --.

Claim 15, Column 14, Line 57, change "intruned" to -- inturned --.

Signed and Sealed this

Twenty-sixth Day of January, 1988

*Attest:*

*Attesting Officer*

DONALD J. QUIGG

*Commissioner of Patents and Trademarks*